US005819385A

United States Patent [19]

Klaptchuk

[11] Patent Number: 5,819,385

[45] Date of Patent: Oct. 13, 1998

[54] COUPLER FOR USE WITH A BURIED VALVE

[76] Inventor: Peter Klaptchuk, 525 Dewdney Ave East, Regina, SK, Canada, S4N 4E9

[21] Appl. No.: 815,887

[22] Filed: Mar. 12, 1997

[51] Int. Cl.[6] ..... B25B 17/00

[52] U.S. Cl. ..... 29/213.1; 29/243.56; 29/267; 29/270; 29/278

[58] Field of Search ..... 29/213.1, 267, 29/270, 278, 243.56, 890.121, 890.124

[56] References Cited

U.S. PATENT DOCUMENTS

| | | | |
|---|---|---|---|
| 729,672 | 10/1903 | Sack . | |
| 1,246,157 | 11/1917 | Remington . | |
| 1,258,016 | 10/1918 | Kepner . | |
| 1,300,423 | 4/1919 | Limpp . | |
| 1,355,544 | 10/1920 | Drane et al. . | |
| 2,649,825 | 5/1953 | Fisher . | |
| 2,884,690 | 5/1959 | Becker . | |
| 4,059,033 | 11/1977 | Johnson . | |
| 4,630,347 | 12/1986 | Chilton | 29/213.1 |
| 4,741,083 | 5/1988 | WOLFE | 29/213.1 |
| 5,054,179 | 10/1991 | Rini | 29/213.1 |
| 5,440,956 | 8/1995 | Johnstun . | |
| 5,557,832 | 9/1996 | Brook | 29/270 |

*Primary Examiner*—Robert C. Watson
*Attorney, Agent, or Firm*—David S. Thompson

[57] ABSTRACT

A coupler for use in replacing a corroded coupler on a buried water line valve without extensive soil excavation is disclosed. A pole having a cotter pin removal tool is provided to remove the cotter pin holding a corroded coupler in place about the valve. A rod having a fastener mounted on its lower end is releasably attachable to the water line valve. The rod carries a sleeve which slidably carries a latching device which is movable from an upper position in which the fastener carried by the rod is mountable on the water line valve, and a lower position in which the fastener is locked in position, allowing the valve to be rotated. The latching device carries a fastener mateable to a fastener carried by the pole, which allows the latching device to be moved between the upper and lower positions.

7 Claims, 5 Drawing Sheets

FIG. 8
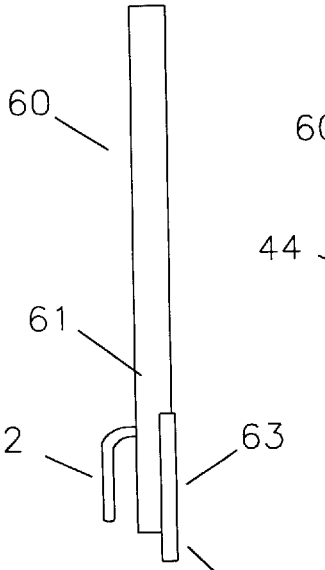
FIG. 9
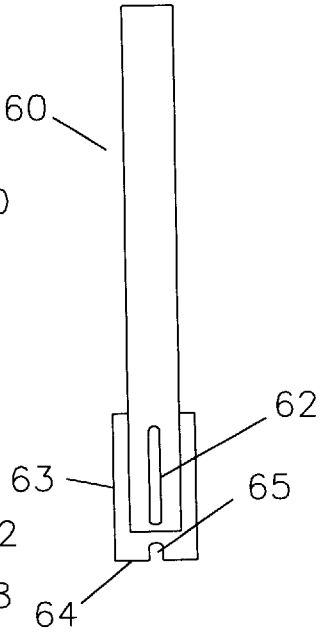
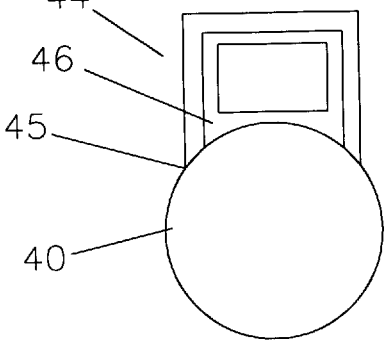
FIG. 10
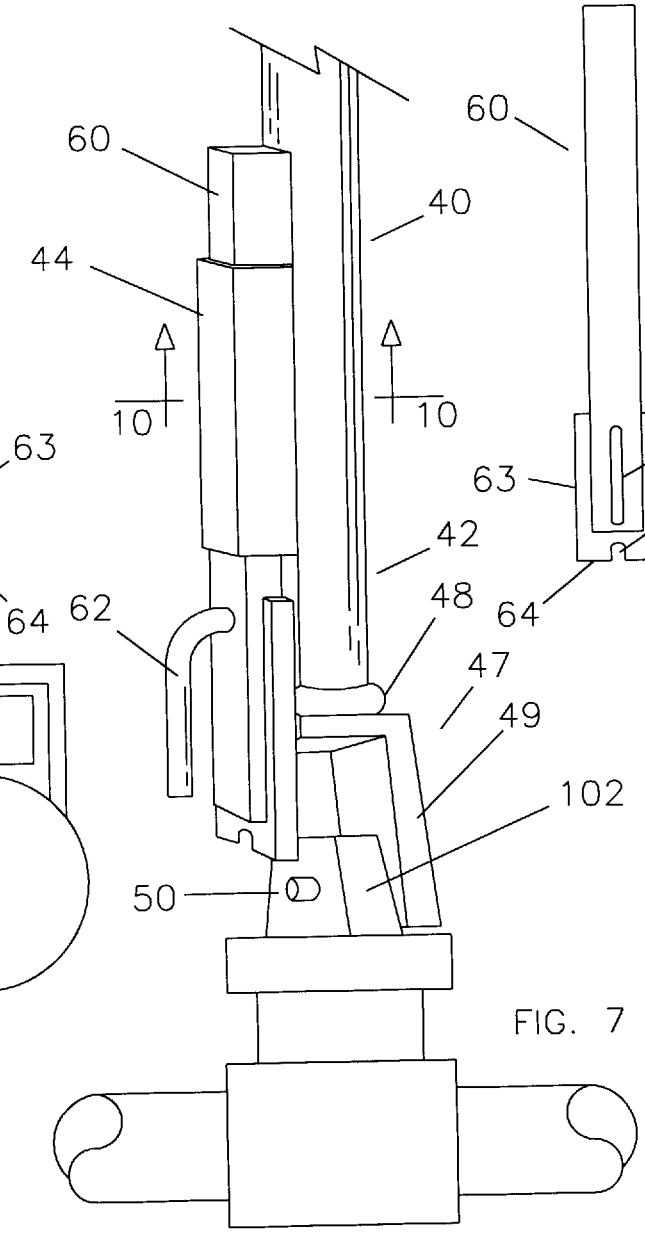
FIG. 7

COUPLER FOR USE WITH A BURIED VALVE

CROSS-REFERENCES

There are no applications related to this application filed in this or any foreign country.

BACKGROUND

Water supply lines are usually buried for convenience and to prevent freezing in cold climates. Where separate supply lines are taken off of a main supply, a valve is provided. Valves such as these can be some distance below the surface, especially in areas with cold winters and low frost lines. To control the valve from the surface after installation, a coupler and extension rod and protective sleeve (sometimes referred to as a "curb box") are usually provided.

It is common for these couplers and extension rods to corrode with time and fail. The most cost effective method of repair, prior to the instant invention, is usually to excavate the area above the valve, provide some method of retention of the unexcavated material, and have repair personnel enter the excavation to facilitate the repair. The newly installed extensions will then have to be supported and the area backfilled with the excavated material.

Some method of repair that could be completed from the surface with a minimum of excavation would be advantageous in terms of time, labor and excavation costs and minimal damage caused by excavation equipment. What is required is a tool capable of operation by workers on the surface, after only very minimal excavation. The tool must be capable of detaching the failed coupler and extension rod from the valve stem of the buried valve, and then replacing it with a new coupler and rod, preferably constructed of higher quality materials. This process should be completed entirely from the surface through a "bore hole" type excavation, large enough to expose only the valve stem assembly and provide for maneuvering of the tool. Such excavation can be completed using a high pressure water jet to break up the soil and a vacuum system providing enough air flow to remove the soil particles.

Unfortunately, where only a "bore hole" type excavation has been done, known tools are operated from the surface are unsatisfactory. A new tool is required for such an operation, and such a tool is the substance of this invention. Importantly, the tool must be operable from a distance, so that only a minimal shaft must be excavated and so that the workmen may remain above the surface of the ground.

SUMMARY

The present invention is directed to an apparatus that satisfies the above needs. A novel coupler for use with a water line valve is provided that allows rapid replacement of a corroded coupler with minimal soil excavation.

The coupler for use with a water line valve of the present invention provides some or all of the following structures.

(A) A rod, having a lower portion and a bottom end, the rod additionally providing:

(a) A sleeve, carried by the lower portion of the rod, for use in slidably carrying the latching bar.

(b) A fastener, carried by the bottom end of the rod, the fastener formed by an off-center leg having a peg adapted to be inserted into the hole in the valve stem of a water line valve, the peg extending generally perpendicularly from the off-center leg.

(B) A latching bar, carried by the sleeve carried by the rod, the latching bar additionally providing:

(a) A hook, carried by the latching rod, which allows a tube connector carried by a pole to raise and lower the latching bar. In its raised position, the latching bar allows the fastener of the rod to be installed onto the water line valve stem. In its lowered position, the latching bar locks the fastener in place, allowing the valve to be operated.

(b) A plate, carried by the latching bar, the plate having a notch sized to fit around the peg. When the latching bar is in its lowered position, the plate, together with the fastener, lock about the water line valve stem.

(C) A pole, having a lower end, the pole additionally providing:

(a) A pin having a bottom end portion sized to remove a cotter pin, the pin carried by the lower end of the pole.

(b) A tube connector, carried by the lower end of the pole, the tube connector having an upper opening sized to fit the hook carried by the latching bar.

It is therefore a primary advantage of the present invention to provide a novel coupler and extension rod for use in replacing a damaged coupler and extension rod attached to a buried water line valve that enables the replacement to be made with only minimal excavation of the soil above the water line valve.

Another advantage of the present invention is to provide a novel coupler for use in replacing a damaged coupler attached to a water line valve that can also be used to remove a damaged coupler from the water line valve.

A still further advantage of the present invention is to provide a novel coupler for use in replacing a damaged coupler attached to a water line valve that provides a latching device that may be locked and unlocked remotely, so that a fastener carried by a rod may be attached to the water line valve and then locked into place.

DRAWINGS

These and other features, aspects, and advantages of the present invention will become better understood with regard to the following description, appended claims, and accompanying drawings where:

FIG. 7 is a perspective view of the rod and attached fastener attached to the valve stem, also showing the latching bar in the unlocked position;

FIG. 8 is a side isometric view of the latching bar;

FIG. 9 is a front isometric view of the latching bar;

FIG. 10 is a cross-sectional view of the rod and attached sleeve, the sleeve carrying the latching bar, along the 10—10 lines of FIG. 7;

DESCRIPTION

Figure 1:
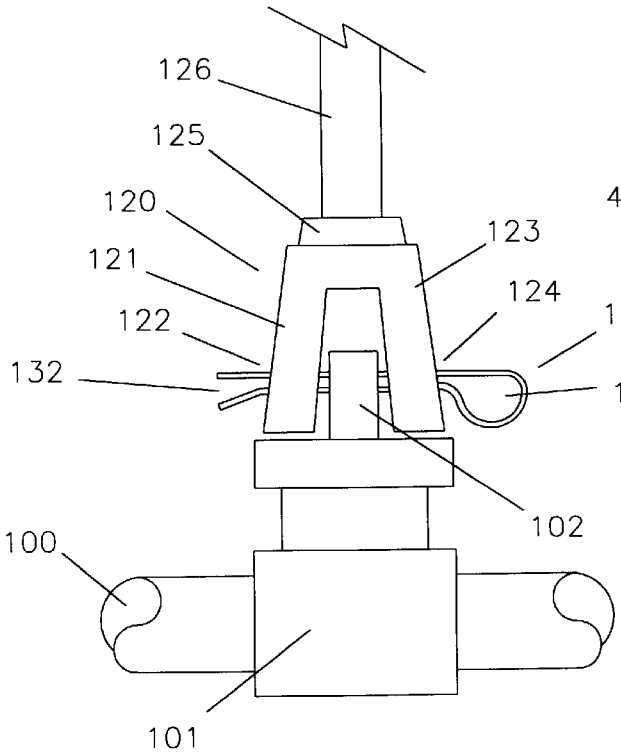
PRIOR ART FIG. 1
FIG. 1 is an isometric side view of the prior art conventional fastener attached by means of a cotter pin to the valve stem of a valve carried by a pipeline.

Referring in particular to FIG. 1, a water line valve of a type suitable for use with a coupler constructed in accordance with the principles of the invention is seen having conventional coupler means attached. A buried pipe 100 having a valve 101 controlled by a valve stem 102 having a hole 103 that is controlled by a conventional fastener 120 having a left leg 121 with a hole 122 and a right leg 123 with a hole 124. A cotter pin 130 connects the fastener 120 to the valve 101. The fastener is attached by a welded connection 125 to a shaft 126, rotation of which allows the valve to be controlled from the surface.

Figures 11, 12, 13:
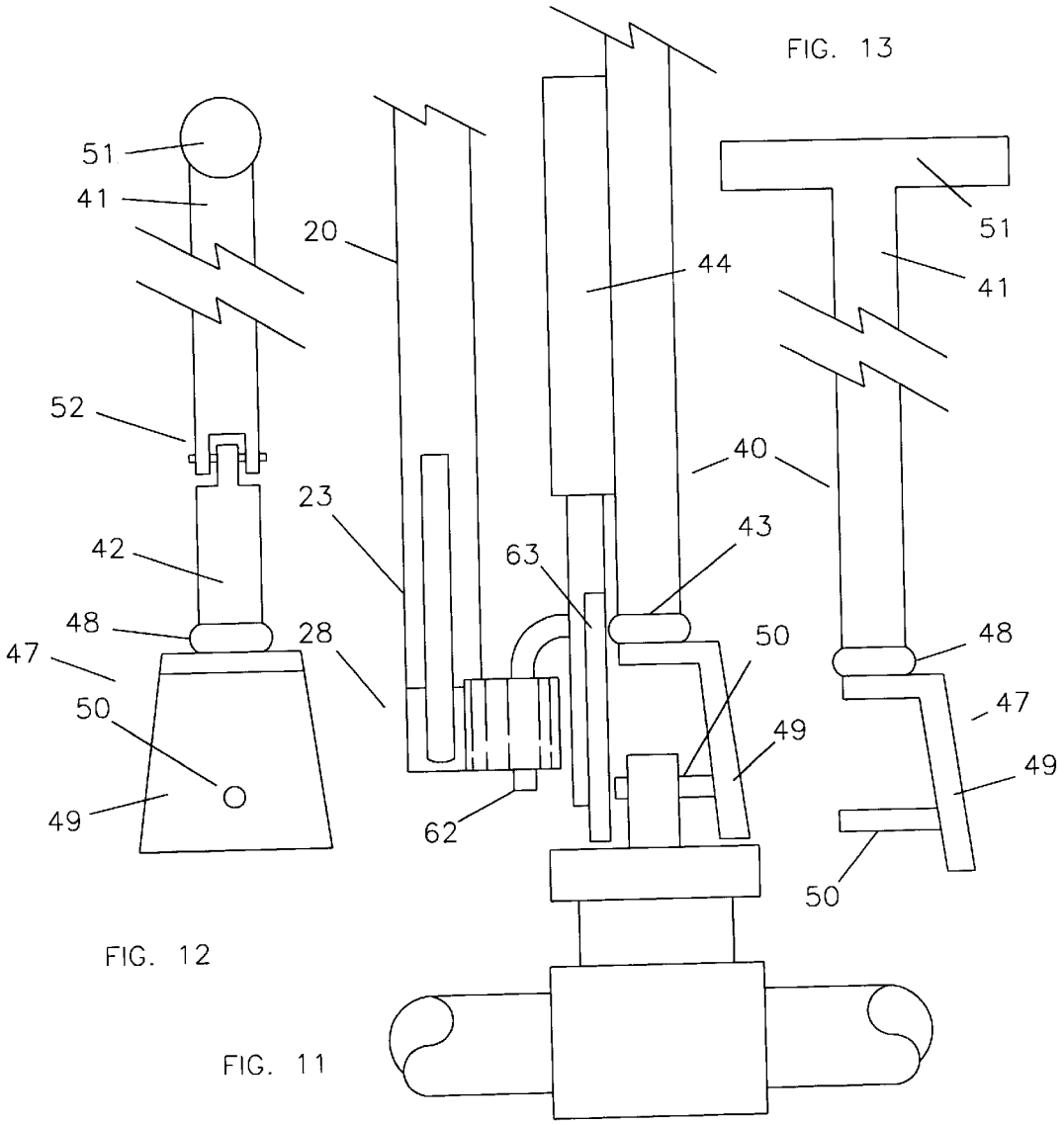
FIG. 11 is a side isometric view of the rod having the fastener attached to the valve, and showing the pole with its attached tube connector attached to the hook of the latching bar, with the latching bar in the closed position.
FIG. 12 is a front isometric view of the rod and attached fastener, showing the optional connector 52.
FIG. 13 is a side isometric view of the rod and attached fastener.

Referring generally to FIGS. 7 and 11, a coupler constructed in accordance with the principles of the invention is seen. The coupler generally provides a rod 40 having an attached sleeve 44 and fastener 47. The fastener 47 may be attached to the water valve 101. The sleeve 44 carries a latching bar 60 which may be moved from an upper unlocked position allowing the fastener 47 to be attached to the valve, and an lower position which locks the fastener about the valve 101. A pole 20 carries a pin 23 for use in removing a cotter pin 130 which secures the conventional fastener 120 to the valve stem 102. The pole also carries a tube connector 30, which is usable connecting to a hook 62 carried by the latching bar, allowing the latching bar to be raised, thereby releasing the fastener 47 from the valve stem 102.

A rod 40 is best seen in FIGS. 2, 7, 11, 12, and 13. The rod provides an upper portion 41 having a handle 51, a lower portion 42 having a bottom end 43 carrying a fastener 47.

An optional connector 52 may be used in a version of the invention where the upper and lower lower portions 41, 42 are disjoint. This can be advantageous, since valves may be buried at any depth. Using the optional connector 52, an upper portion 41 of a length required due to the depth of the buried valve may be attached to the lower portion 42, carrying the sleeve 44 and fastener 47. Thus the upper portion 41 could be manufactured in a variety of lengths.

Figure 2:
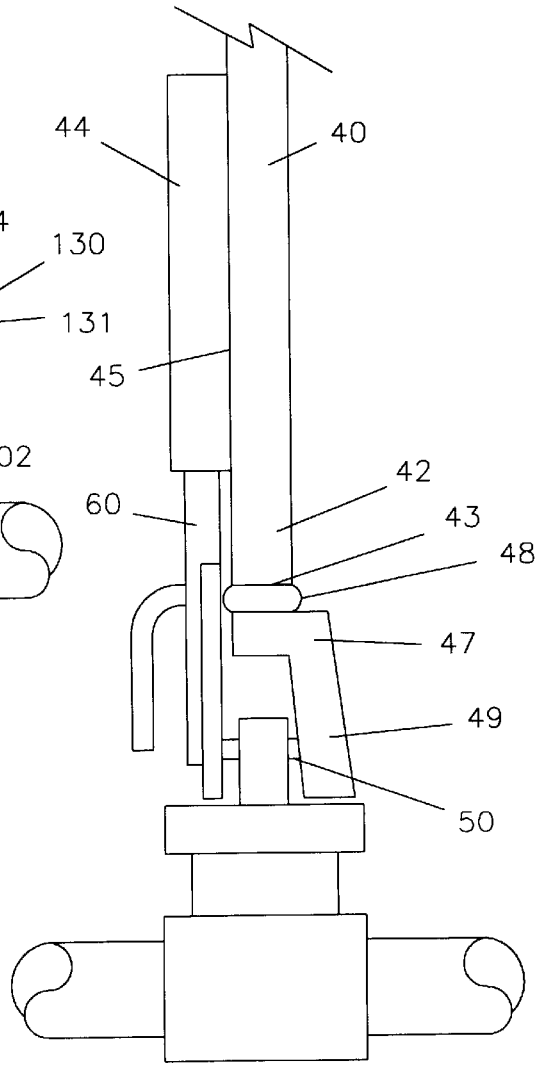
FIG. 2 is an isometric side view of a rod and latching bar of a version of the invention attached to the valve, wherein the latching bar is in the closed or locked position.

As seen in FIG. 2, 7 and 11, fastener 47 is attachable to the valve stem 102 of the buried valve 101. The fastener is attached to the bottom end 43 of the rod 40 by fastening means such as welded connection 48. An off-center leg 49 carries a perpendicularly extending peg 50. The peg is sized to fit through a standard sized hole 103 in the valve stem 102 of the valve 101.

A connector such as sleeve 44, forming a channel 46, is attached to the rod 40 by fastening means such as welded connection 45. The sleeve 44 allows the latching bar 60 to be slidably carried by the rod 40.

A pole 20 having an upper end 21 and a lower end 22 is used for two purposes. In support of its first use, the pole 20 provides a cotter pin removal means for removing the cotter pin 130 which attaches a conventional fastener 120 to the valve stem 102. The cotter pin removal means may take the form of pin 23. Pin 23 provides an upper portion 24 and a lower portion 25 having a bottom end 26 that is sized to fit into the loop 131 of the cotter pin 130 to be removed. The pin 23 is attached to the lower end 22 of pole 20 by fastening means such as welded connections 27.

The lower end 22 of the pole provides a notch 28 and a half-round lower surface 29. The notch facilitates the attachment of the tube connector 30 to the lower end 22 during the manufacturing process, and also tends to allow the bottom end 26 of pin 23 to be more easily inserted into the looped end 131 of a cotter pin.

A connector is carried by the pole 20 for attachment to an associated connector carried by the latching bar 60, so that the pole 20 may be releasably attached to the latching bar so that the latching bar may be moved upwardly. In the preferred embodiment, a tube connector 30 forms a channel 31 between an upper opening 32 and a lower opening 33. The tube connector is attached by fastening means such as welded connection 34 to the lower end 22 of the pole 20.

Latching means for releasably locking the fastener 47 onto the valve stem 102 of the valve 101 is carried by the rod 40. In the preferred embodiment of the invention, the latching means provides a latching bar 60 which slides within the channel 46 of the sleeve 44 carried by the rod 40. The latching bar slides between an upper, unlocked position, and a lower locked position. The upper position, as seen in FIG. 7, allows the fastener 47 to be attached to the valve stem 102. The lower position, as seen in FIG. 2 locks the fastener 47 about the valve stem, allowing the valve to be opened or closed by rotation of the rod by means of handle 51.

The latching bar 60 carries on its lower portion 61 a plate 63. A lower portion 64 of the plate defines a notch 65, sized to fit around the peg 50 when the latching bar is in the lowered position, as seen in FIG. 2. The plate is sized so that, when the latching bar is lowered, the plate 63 and off-center leg 49 straddle the valve stem 102 in a manner similar to the left and right legs 121 and 123 of the conventional fastener 120.

A connector is carried by the latching bar 60 for attachment to an associated connector carried by the pole 20, so that the pole and latching bar may be releasably attached, so that the latching bar may be moved upwardly by workmen some distance away. In practice, various combinations of hooks, rings, sockets or other fasteners may be used. In the preferred embodiment, a hook 62 is releasably attachable to tube connector 30. The hook 62 is attached by fastening means such as a welded connection to the latching bar.

To use the previously described version of the invention, the user first must excavate a minimal amount of soil above the valve 101. Typically, the soil excavated may include a hole of 18" to 24" diameter, having a depth roughly equal to the distance from the surface of the valve. This may be done by any of several known methods, preferably including high pressure water and vacuum removal equipment. One example of such a high pressure system is disclosed by Canadian patent number 2,104,723, although other similar excavation systems are known and could alternatively be used.

Figure 3:
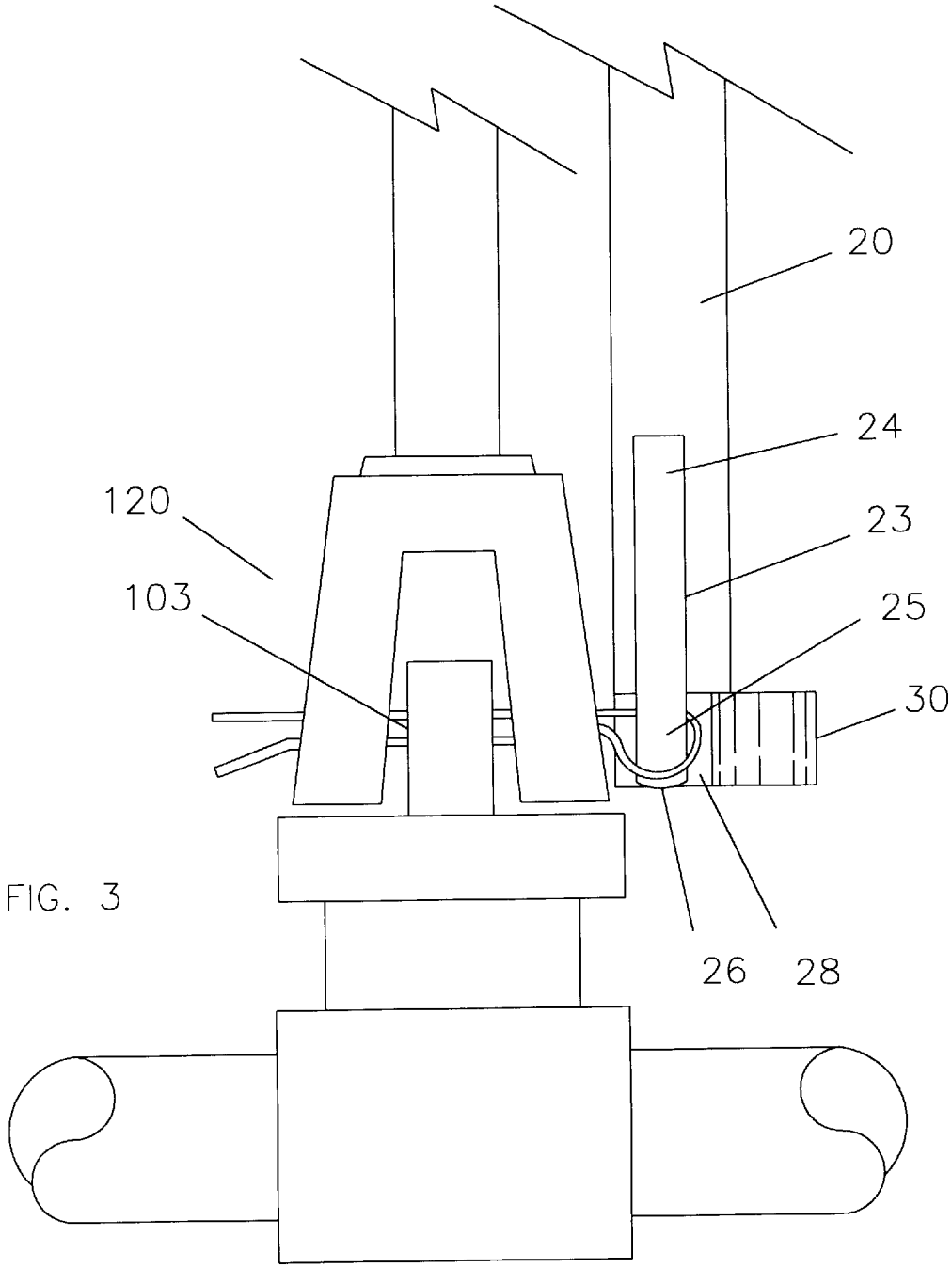
FIG. 3 is a view of the prior art conventional fastener, showing how the pole and a version of the cotter pin removal means of the invention may be used to remove the conventional fastener from the valve stem.
Figures 4, 5, 6:
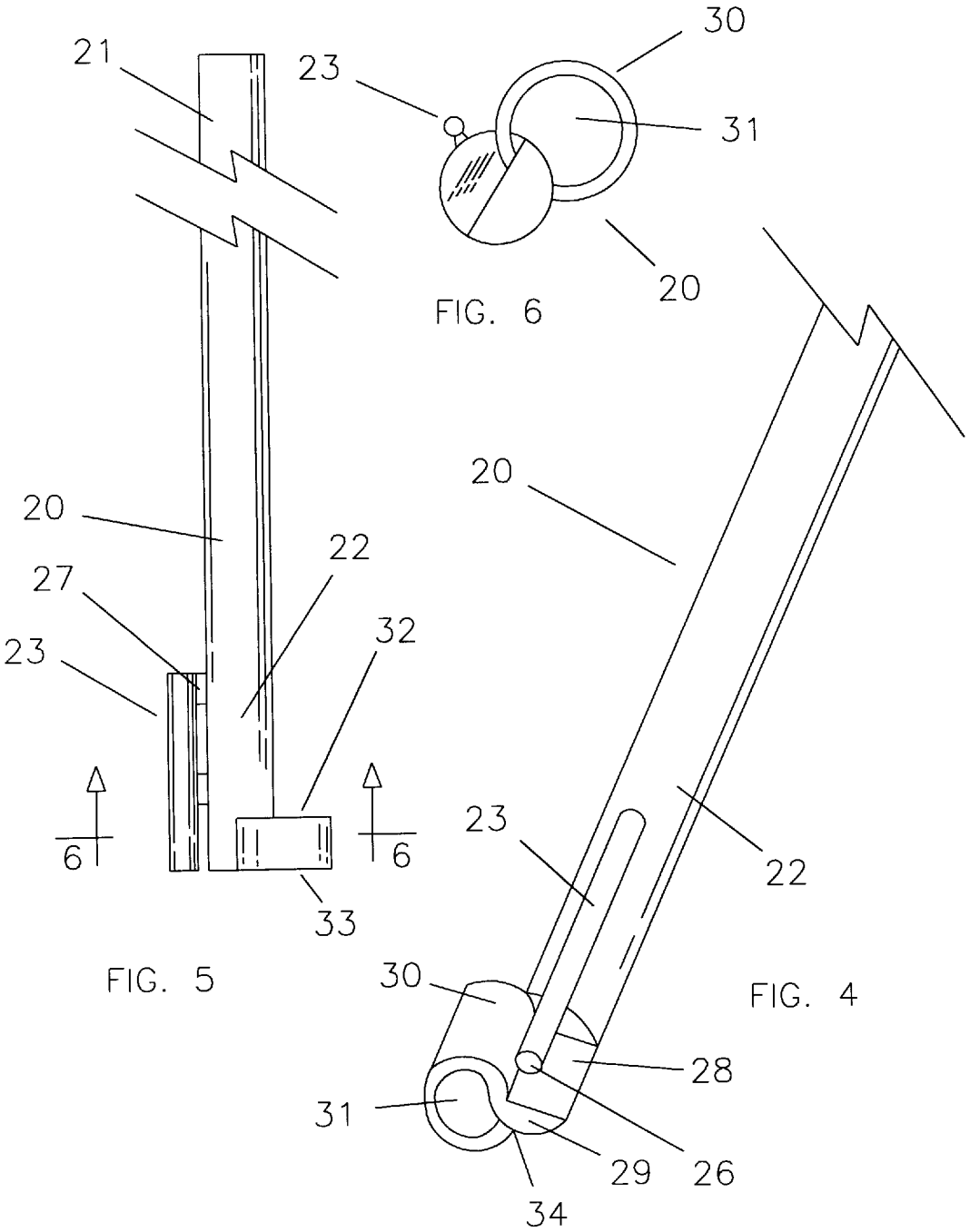
FIG. 4 is a perspective view of the pole showing the attached pin for cotter pin removal and showing the attached tube connector for connecting to the hook of the latching bar.
FIG. 5 is a side isometric view of the pole of FIG. 4.
FIG. 6 is a cross-sectional view of the pole, attached cotter pin removing pin and attached tube connector of FIG. 5, taken along the 6—6 lines.

The cotter pin 130 securing the conventional fastener 120 to the valve stem 102 is then removed. This is done by lowering the pole 20 into the hole made by excavation of the soil, and then passing the bottom end 26 of the pin 23 into the loop 131 of the cotter pin, as seen in FIG. 3. The pole is then rotated, causing the tube connector 30 to press against the leg 123 of the conventional fastener 120, causing the legs 132 of the cotter pin to straighten and the cotter pin to be retracted. Such cotter pins are typically made of non-ferrous metal, and will have little or no corrosion. The conventional fastener is then pulled out of the excavated hole.

The rod 40 is lowered into the excavated hole. The tube connector 30 of the pole 20 is then connected to the hook 62 of the latching bar, and is used to raise the latching bar into the open position, as seen in FIG. 7. The fastener 47 is then attached to the valve stem 102 by passing the peg 50 carried by the center leg 49 through the hole 103 in the valve stem 102. The pole 20 is then lowered, disengaging the tube connector 30 from the hook 62, thereby letting the latching bar move to the locked position, seen in FIG. 2. If needed, the half round surface 29 may be tapped on the top of the latching bar 60 to force it downwardly. The valve may then be operated by use of handle 51. If desired, the tube connector 30 may be used to connect to the hook 62 and to raise the latching bar, allowing disengagement of the fastener 47 and removal of the rod 40.

A "curb box" having a tubular body with a closed or partly closed top end and a lower open end having a "saddle cut" to fit on the pipe may be placed over the valve for protection.

The previously described versions of the present invention have many advantages, including a primary advantage of providing a novel coupler for use in replacing a damaged coupler attached to a buried water line valve that enables the replacement to be made with only minimal excavation of the soil above the water line valve.

Another advantage of the present invention is to provide a novel coupler for use in replacing a damaged coupler attached to a water line valve that can also be used to remove a damaged coupler from the water line valve.

A still further advantage of the present invention is to provide a novel coupler for use in replacing a damaged coupler attached to a water line valve that provides a latching device that may be locked and unlocked remotely, so that a fastener carried by a rod may be attached to the water line valve and then locked into place.

Although the present invention has been described in considerable detail and with reference to certain preferred versions, other versions are possible. For example, the pole 20 carries a tube connector 30 and the latching bar 60 carries a hook 62. The tube 30 and hook 62 may be releasably attached. While in keeping with the teachings of the invention, a variety of other releasable fasteners could replace these fastening elements. For example, pole 20 could be fitted with an upwardly directed hook and latching bar 60 could be fitted with a tube connector, if desired. Additionally, while the latching bar 60 is slidably carried by sleeve 44 of rod 40 in the preferred embodiment of the invention, the latching bar might alternatively be pivotably carried by the rod 40. And, while the invention is primarily useful with respect to water line valves, it has obvious utility with similar valves carried by pipes used with oil, gas and other materials. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A coupler for use with a buried valve, comprising:

(a) a rod, comprising:
  (a) a first connector, carried by the rod; and
  (b) fastener means, carried by the rod, for attachment by the water line valve; and (b) latching means, carried by the first connector carried of the rod, for releasably locking the fastener means about the water line valve, the latching means carrying a second connector; and (c) a pole comprising:
  (a) cotter pin removing means, carried by the pole, for removing a cotter pin from a hole in a valve stem carried by the water line valve; and
  (b) a third connector, carried by a lower end of the pole, the third connector being releasably attachable to the second connector.

2. The coupler of claim 1, in which the first connector comprises a sleeve.

3. The coupler of claim 1, in which the fastener means comprises an off-center leg and a peg, the peg extending perpendicularly from the off-center leg.

4. The coupler of claim 1, in which the latching means additionally comprises a plate, carried by the latching means, the plate defining a notch sized to fit around the peg.

5. The coupler of claim 1, in which the second connector comprises a hook.

6. The coupler of claim 1, in which the third connector comprises a tube connector.

7. A coupler for use with a buried valve, comprising:

(a) a rod, having a lower portion and a bottom end, the rod additionally comprising:
  (a) a sleeve, carried by the lower portion; and
  (b) a fastener, carried by the bottom end, comprising an off-center leg and a peg, the peg extending perpendicularly from the off-center leg;

(b) a latching bar, carried by the sleeve carried by the rod, the latching bar additionally comprising:
  (a) a hook, carried by the latching bar; and
  (b) a plate, carried by the latching bar, the plate defining a notch sized to fit around the peg; and (c) a pole, comprising:
  (a) a pin having an end portion sized to remove a cotter pin, the pin carried by a lower end of the pole; and
  (b) a tube connector, carried by the lower end of the pole, the tube connector having an upper opening releasably fastenable to the hook carried by the latching bar.

* * * * *